US007121812B2

(12) United States Patent
Forrest

(10) Patent No.: US 7,121,812 B2
(45) Date of Patent: Oct. 17, 2006

(54) HIGH PRESSURE PUMP HAVING REPLACEABLE PLUNGER/VALVE CARTRIDGES

(75) Inventor: Jamie A. Forrest, Fenton, MI (US)

(73) Assignee: NLB Corp., Wixom, MI (US)

( * ) Notice: Subject to any disclaimer, the term of this patent is extended or adjusted under 35 U.S.C. 154(b) by 127 days.

(21) Appl. No.: 10/370,158

(22) Filed: Feb. 19, 2003

(65) Prior Publication Data

US 2004/0161351 A1 Aug. 19, 2004

(51) Int. Cl.
*F04B 39/10* (2006.01)
*F16K 31/12* (2006.01)

(52) U.S. Cl. ..... 417/269; 417/567; 417/571; 137/509; 137/514.5

(58) Field of Classification Search ..... 417/364, 417/238, 269, 415, 419, 471, 521, 529, 559, 417/572, 571, 567; 137/509, 514.5
See application file for complete search history.

(56) References Cited

U.S. PATENT DOCUMENTS 3,702,624 A * 11/1972 Fries ..... 137/512
4,173,435 A * 11/1979 Hammelmann ..... 417/469
4,250,916 A * 2/1981 Hoffmann ..... 137/514.5
4,682,531 A * 7/1987 Mayer ..... 91/446
4,878,815 A * 11/1989 Stachowiak ..... 417/63
5,167,971 A * 12/1992 Gill et al. ..... 425/559
5,171,136 A * 12/1992 Pacht ..... 417/571
5,230,363 A * 7/1993 Winn et al. ..... 137/512.3
5,253,987 A * 10/1993 Harrison ..... 417/566
6,073,648 A * 6/2000 Watson et al. ..... 137/375
6,206,667 B1 * 3/2001 Turner et al. ..... 418/178

* cited by examiner

*Primary Examiner*—Charles G. Freay
(74) *Attorney, Agent, or Firm*—Carlson, Gaskey & Olds

(57) ABSTRACT

A high pressure fluid jetting system generally includes a fluid cylinder pump, a drive assembly, a pressurized liquid supply and an applicator gun. The drive assembly includes a diesel engine or electric powered motor which drives a rotatable drive shaft. The drive shaft drives a triple plunger which are reciprocally driven. A valve seat assembly and a cylindrical cartridge seal assembly define a cartridge which contains a reciprocating plunger shaft. The primary high wear parts are located therein. The cartridge is retained within the manifold cartridge opening yet is readily accessible by removal of the manifold. The pump output is primarily determined by the diameter of the plunger the length of the stroke, the number of cylinders, and the speed of the pump. A specific cartridge allows replacement of all the components which interface with a plunger shaft of a predetermined diameter such that a change in pump output or repair is readily achieved by straightforward cartridge replacement.

33 Claims, 6 Drawing Sheets

HIGH PRESSURE PUMP HAVING REPLACEABLE PLUNGER/VALVE CARTRIDGES

BACKGROUND OF THE INVENTION

The present invention relates to a high pressure fluid pump system, and more particularly to a fluid pump system with a hinged manifold which provides for replacement of high wear components as a cartridge without complete pump system disassembly.

Systems that perform water jetting operations such as surface preparation, cutting cleaning, coating removal and other operations are known. The systems typically use a fluid cylinder having reciprocating plungers to force the fluid out of an applicator at extremely high pressure. As the plungers reciprocate within the fluid cylinder, the fluid cylinder and components thereof cycle between atmospheric and maximum system pressure.

Due in part to the cyclical operation between high and low pressure, the system components undergo extreme stresses. The life span of some high wear components may be reduced in relation to the other system components. Typically, the high wear components are located deep within a fluid cylinder assembly which is bolted together with bolts which pass through the entire assembly. To access the high wear components, the fluid cylinder, manifold, and other components must be disassembled. This often requires the removal of a multiple of bolts, nuts and housing components to disassemble the pump and access the worn components. Although providing a strong and robust system, such a disassembly process may be relatively time consuming and difficult in a field environment.

Conventional pump systems provide a predetermined flow rate and displacement as a pump system is specifically designed to provide a predetermined pump displacement and pressure. Moreover, pump system frame assemblies are typically design limited with regard to the predetermined flow rate and displacements. Although effective, multiple pump systems may be required in which each is utilized to perform a particular task. This may be somewhat inefficient in terms of transport cost, duplicate system expense, and maintenance.

Accordingly, it is desirable to provide a pump system which allows convenient access to high wear internal components and which provides field replaceable components which readily converts the pump to achieve a variable pump displacement and pressure.

SUMMARY OF THE INVENTION

The present invention provides a high pressure fluid jetting system which generally includes a fluid cylinder pump, a drive assembly, a pressurized liquid supply and an applicator gun. The fluid cylinder pump operates to selectively jet water from the gun.

The drive assembly includes a diesel engine or electric powered motor which drives a rotatable drive shaft. The drive shaft reciprocally drives a triple plunger.

A valve seat assembly and a cylindrical cartridge seal assembly define a cartridge which contains each reciprocating plunger. The primary high wear parts are located therein such that by replacing the cartridge, the pump may be rapidly changed over or repaired.

The cylindrical cartridge seal assembly includes a step which engages a corresponding counterbore in a frame cartridge opening of the pump. The cartridge is inserted into the frame and retained by the manifold. The cartridge is readily accessible by removal of the manifold. An extremely rigid assembly is provided which transfers the internal pressure from the fluid through the cartridge and into the frame.

The valve seat assembly includes a suction valve which is of a bell shape having a cylindrical body and a skirt extending therefrom. An axial suction valve passage passes through the longitudinal length of the suction valve along a suction valve axis. A multiple of windows allow fluid to flow from a multiple of radial passageways in the valve seat assembly through the suction valve and into the fluid pumping chamber. The suction valve is coated with a low friction coating such as Tungsten Carbide Carbon or Titanium Dioxide.

By mounting an alternative cartridge within the pump, the pump output is varied. The pump output is primarily determined by the diameter of the plunger, the length of the plunger stroke, the number of cylinders, and the speed of the pump. A specific cartridge allows replacement of all the components which interface with a plunger of a particular diameter such that a change in pump output is readily achieved by cartridge replacement.

Replacement of worn components is also readily achieved by replacement of the entire cartridge. Such replacement is readily achieved in a field environment. The cartridge itself may be further repaired in a shop environment where the cartridge is refurbished through replacement of just the worn, yet more difficult to replace components.

Accordingly, the present invention provides a pump system which allows convenient access to high wear internal components and which provides field replaceable components which readily converts the pump to achieve a variable pump displacement and pressure. The present invention further provides replaceable components which are long-lasting while providing consistent high pressure operating.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
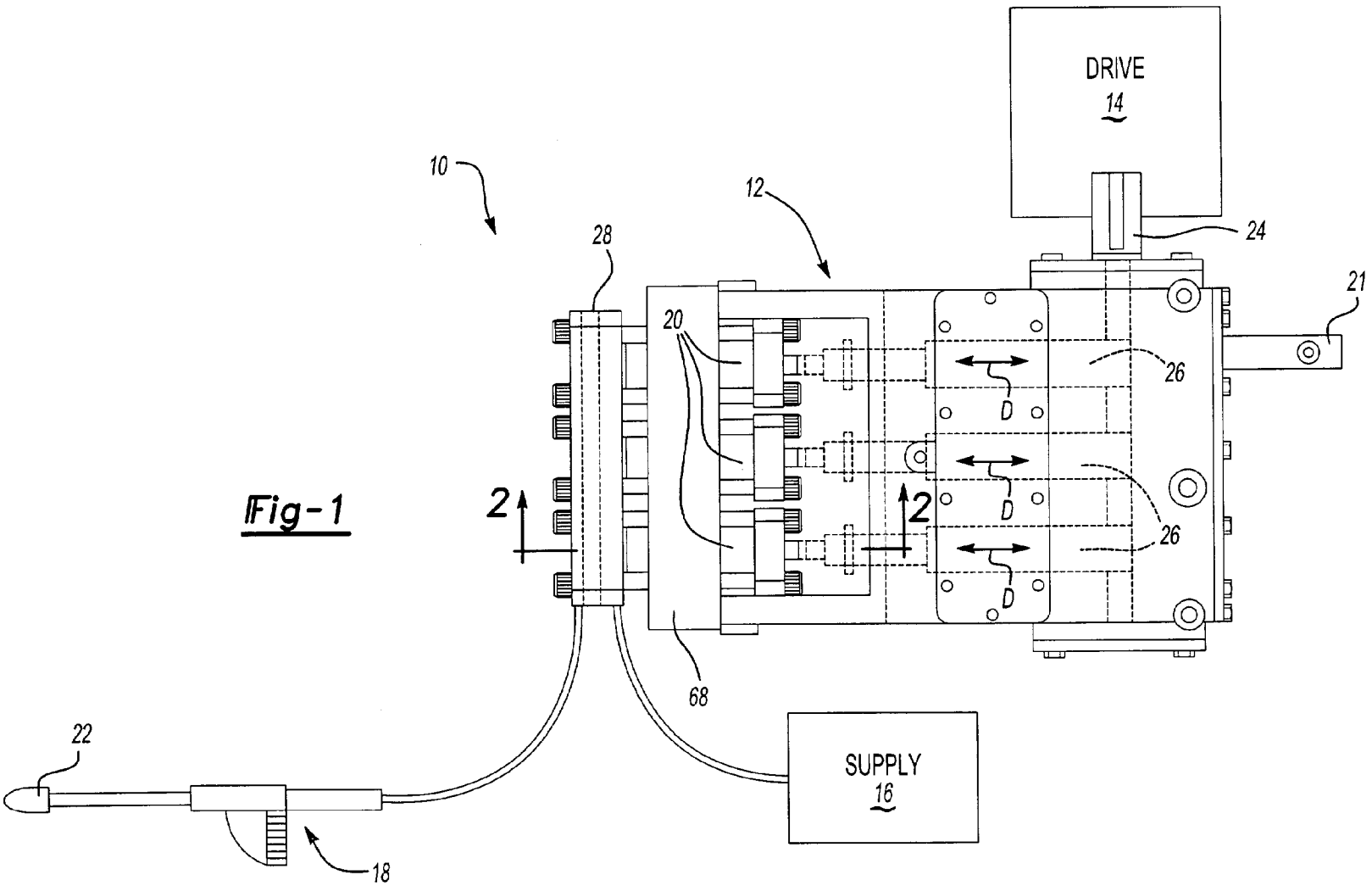
FIG. 1 is a partial schematic view of a high pressure fluid jetting system according to the present invention.

FIG. 1 illustrates a high pressure fluid jetting system 10. The system 10 generally includes a fluid cylinder pump 12, a drive assembly 14, a pressurized liquid supply 16 and an applicator gun 18. Preferably, the fluid cylinder pump 12 operates to selectively jet water from the gun 18 at a variable pressure and flow rate through replacement of internal pressure cartridges 20 (also illustrated in FIG. 2). A by-pass valve 21 provides for fine-tuning of the system pressure.

The drive assembly 14 includes a diesel engine or electric powered motor which drives a rotatable drive shaft 24. Drive shaft 24 drives a triple plungers 26 which are reciprocally driven in the direction of doubled headed arrows D along axis P. Plungers 26 communicate fluid from the supply 16 to the gun 18, such that the fluid is discharged form the nozzle 22 at a pressure based upon the selected cartridge 20.

As the nozzle 22 of the gun 18 wears, by pass valve 21 may be adjusted automatically or manually such that the fluid pressure is maintained at a desired pressure. The pressure is produced by the flow displacement of the fluid within the pump 12 which is then restricted by the nozzle 22. In other words, without nozzle 22, the fluid would be driven from gun 18 at a relatively low velocity.

Figure 2:
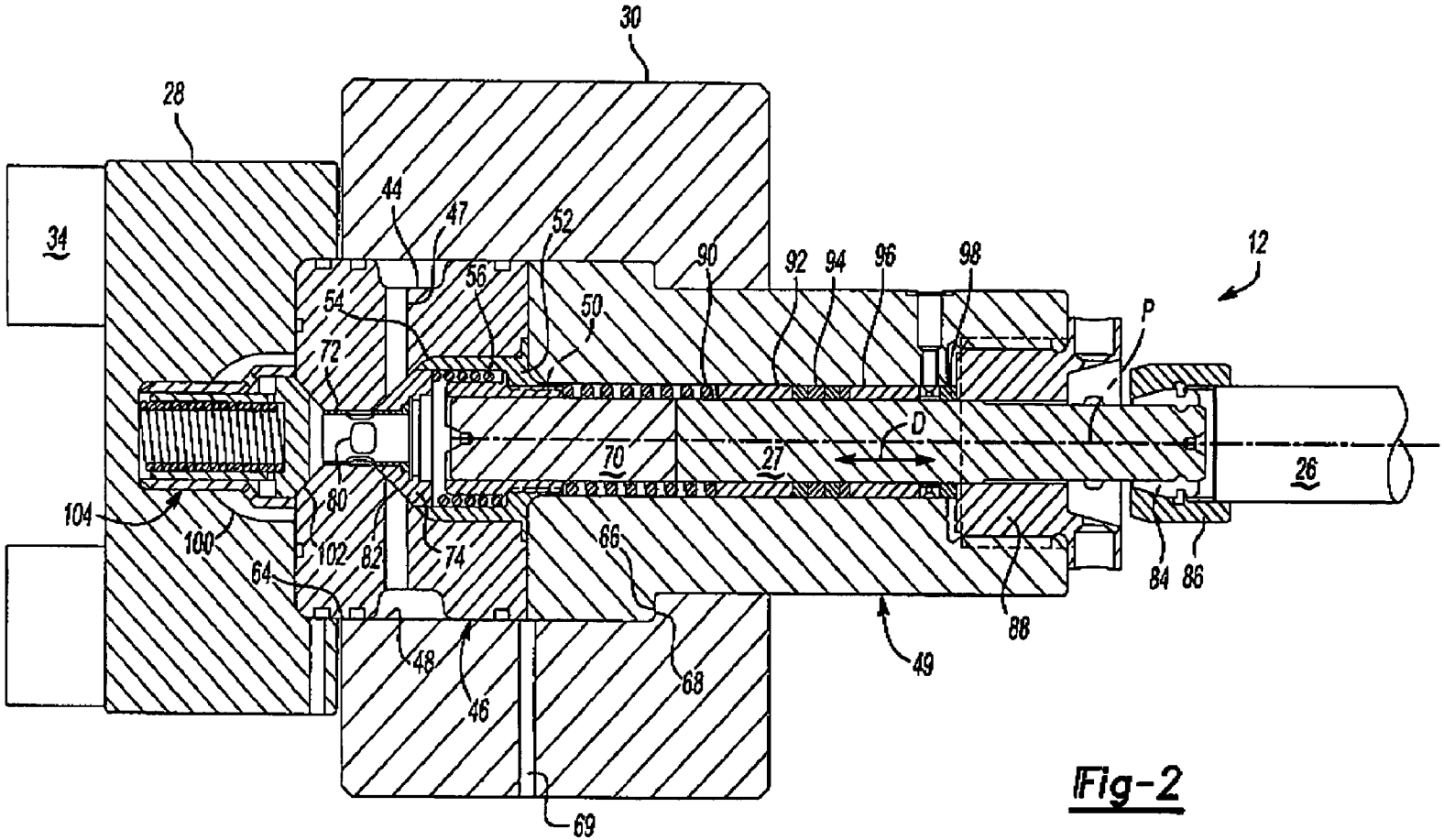
FIG. 2 is a sectional view of the fluid cylinder pump of FIG. 1.

Referring to FIG. 2, a sectional view of the pump 12 is illustrated. A manifold 28 is mounted to an end of a frame 30. Fasteners 34 such as bolts or the like retain the manifold 28 to the frame 30. That is, fasteners 34 are threaded into threaded apertures 36 which pass only partially into frame 30 (FIG. 3) and need not pass completely therethrough as in conventional pump systems. Each of a multiple of threaded apertures 36 receives a fastener 34 to maintain the pump 12 in an assembled condition and provide structural support therefore. As the threaded apertures 36 do not necessarily pass completely through the frame 30, a stronger component is achieved and higher loads may be applied.

Figure 3:
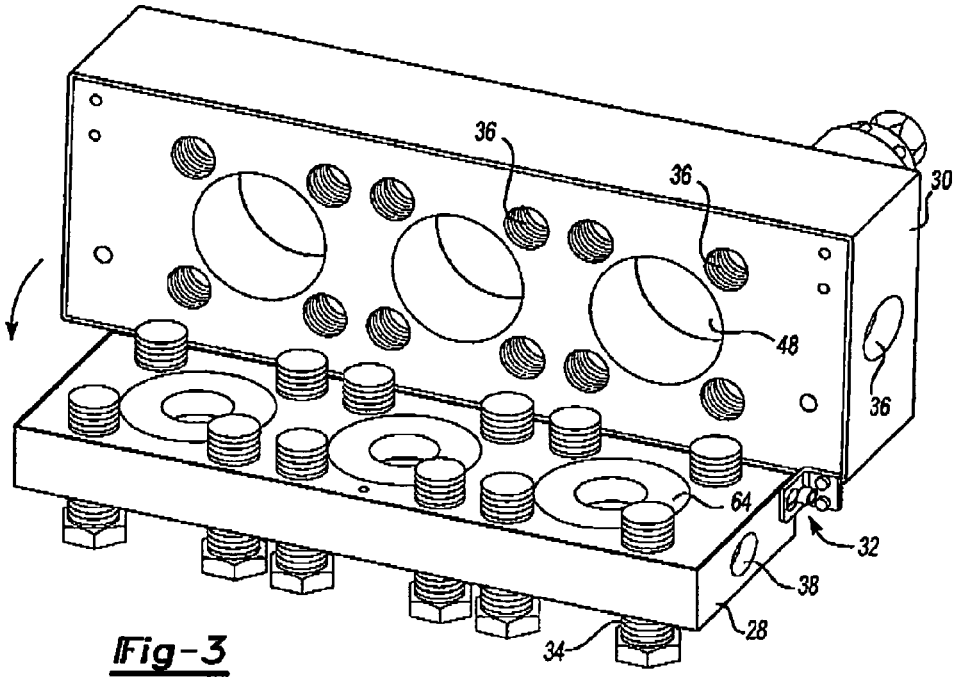
FIG. 3 is a perspective view of a manifold pivoted away from a power frame of the fluid cylinder pump illustrated in FIG. 2.

By unthreading fasteners 34 from the frame 30, the manifold 28 may be pivoted upon pivot 32 to provide access to the cartridges 20 (FIG. 3). Maintenance and changeover is thereby rapidly and conveniently achieved.

A suction port 36 is located in the frame 30 and a discharge port 38 is located in the manifold 28. As the suction port 36 and the discharge port 38 are located on separate components, each component requires less machining, is stronger and higher loads may be applied. Although located in separate components, the suction port 36 and the discharge port 38, are located in close proximity to each other to provide efficient operation.

Figure 4:
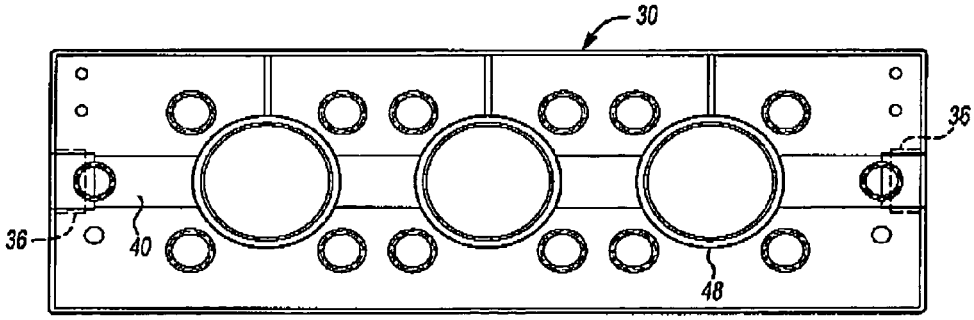
FIG. 4 is a front view of the interface of the frame.
Figure 5:
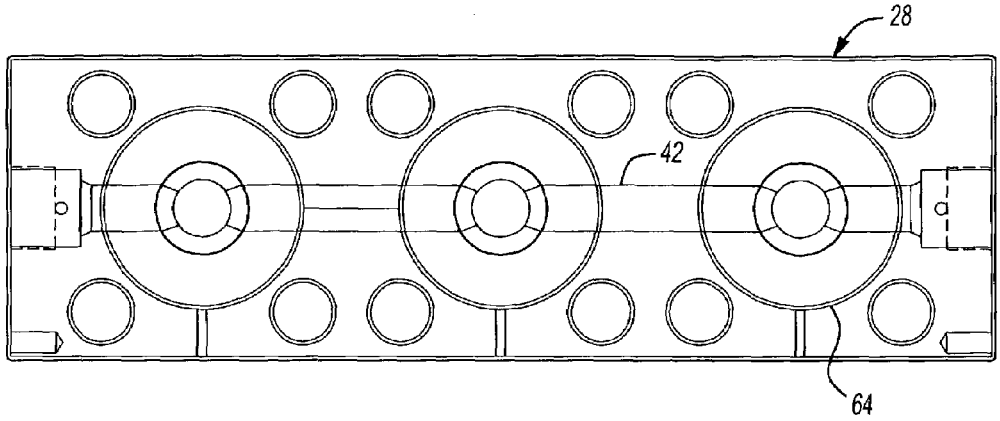
FIG. 5 is a front view of the interface of the manifold.

The suction port 36 and the discharge port 38 lead to a rifle-drilled suction passage 40 (FIG. 4) and a rifle-drilled discharge passage 42 (FIG. 5) respectively. The rifle-drilled suction passage 40 and a rifle-drilled discharge passage 42 exit each side of the frame 30 and manifold 28 respectively such that the fluid maybe communicated into or out of either side to provide further versatility. One end of the rifle-drilled suction passage 40 and a rifle-drilled discharge passage 42 need only be plugged while the other receives a connector for a conduit.

The suction bore 44 is sized to reduce the amount of turbulence and maintain the fluid flow below approximately 2 feet per second. The relatively slow speed insures that only low acceleration forces are required to bring the fluid from supply 16 (FIG. 1) up to speed. Further, the low fluid flow velocity provides a reduction in the corresponding pressure drop created by the potential energy transferred from the fluid pressure to the kinetic energy from the plungers 26 which accelerate the fluid.

As the plunger 26 is retracted away from the manifold 28 (to the right in FIG. 2) a plunger shaft 27 is retracted from the cartridge 20. Fluid flows from the suction port 36 into the suction passage 40 within the frame 30. Importantly, it should be understood that the plunger shaft 27 does not draw fluid into the pump 12 but allows fluid to flow into the pump 12 from the pressurized supply 16 (FIG. 1).

A forcing cone 84 and collar 86 are mounted to the plunger shaft 27 opposite the suction valve assembly 46. The forcing cone 84 and collar 86 provide rapid attachment of each plunger shaft 27 to each plunger 26 and the rotatable drive shaft 24 (FIG. 1). That is, the collar 86 is threaded to the plunger 26 to rapidly connect and disconnect the plunger shaft 27 to the drive assembly 14.

Fluid fills the suction passage 40 and an annular passage 44 located about a valve seat assembly 46 located within a frame cartridge opening 48 in the frame 30. That is, the valve seat assembly 46 fits into the frame cartridge opening 48 behind a cylindrical cartridge seal assembly 49.

Figure 6:
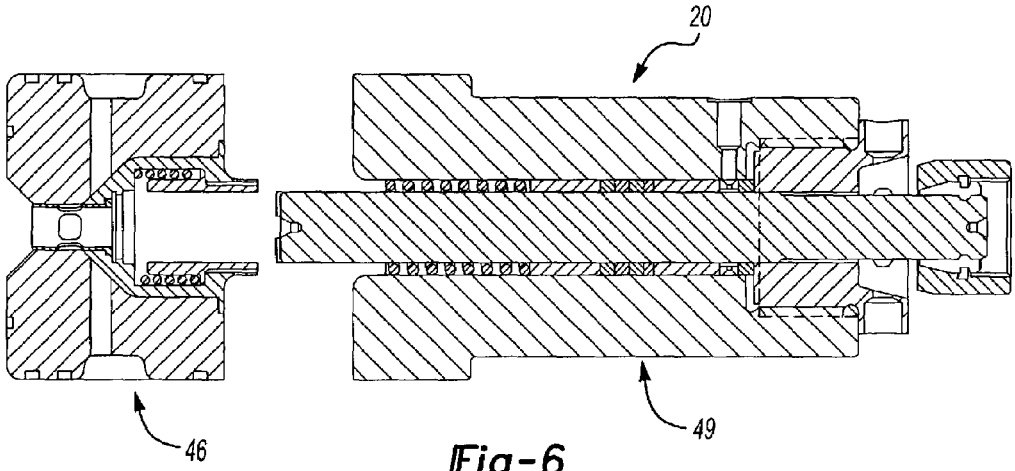
FIG. 6 is a sectional view of the cartridge of FIG. 2.

The valve seat assembly 46 and the cylindrical cartridge seal assembly 49 define a cartridge 20 (FIG. 6). The primary high wear parts are located therein as will be further described. Suffice to say, by replacing the cartridge 20, a pump 12 may be rapidly changed over or repaired.

Figure 8:
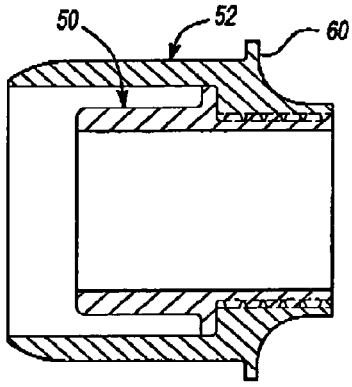
FIG. 8 is a sectional view of a section valve inner and outer guide.
Figure 9:
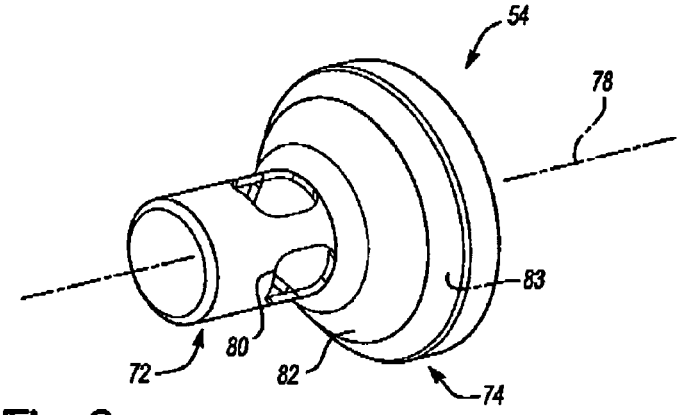
FIG. 9 is a perspective view of a suction valve which fits into the valve seat of FIG. 7.

From the annular passage 44, the fluid enters the center of the valve seat assembly 46 through a multiple of radial passageways 47. The valve seat assembly 46 includes a valve seat 45 (also illustrated in FIG. 7), an inner cartridge stop 50, an outer cartridge guide 52 (also illustrated in FIG. 8), a suction valve 54 (also illustrated in FIG. 9), and a suction valve spring 56.

Figure 7:
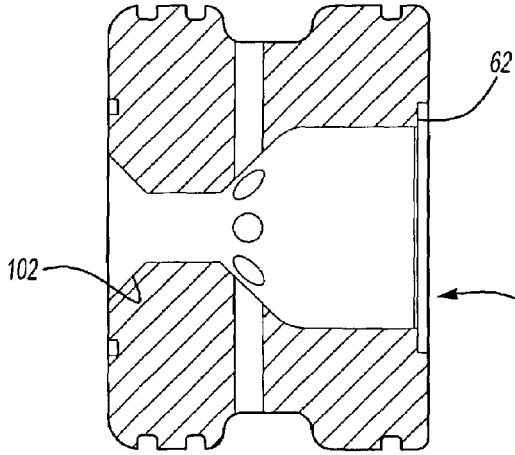
FIG. 7 is a sectional view of a valve seat.

The inner cartridge stop 50 closely fits about the plunger shaft 27. The outer cartridge guide 52 includes a flange 60 (FIG. 8) which engages a counterbore 62 located in the valve seat 45 (FIG. 7). The valve seat 45 abuts the cylindrical cartridge seal assembly 49 located in the frame cartridge opening 48 on one side and a manifold cartridge opening 64 on the other side. Each manifold cartridge opening 64 aligns with each frame cartridge opening 48 to receive and retain the cartridge 20.

The cylindrical cartridge seal assembly 49 includes a step 66 which engages a corresponding counterbore 68 in the frame cartridge opening 48. The cartridge 20 is thereby retained within the manifold cartridge opening 64 and the frame cartridge opening 48 yet is readily accessible by removal of the manifold 28. An extremely rigid assembly is provided which transfers the internal pressure from the fluid through the cartridge 20 and into the frame 30 and manifold 28.

The frame 30 preferably includes a multiple of weep apertures 69 to provide predefined pressure relief points preferably located where the valve seat assembly 46 abuts the cylindrical cartridge seal assembly 49 to assure a safe failure divert direction for the fluid.

The suction valve 54 moves relative the inner cartridge stop 50 and the outer cartridge guide 52 in response to movement of the plunger shaft 27 and the bias of valve spring 56. Once the plunger 26 reaches its full outward position, a fluid pumping chamber 70 (illustrated in phantom at 70) and the center of the valve seat 45 is filled with fluid such that the suction valve 54 checks closed under the bias of spring 56.

The suction valve 54 is preferably of a bell shape having a cylindrical body 72 and a skirt 74 extending therefrom. An axial suction valve passage 76 passes through the longitudinal length of the suction valve 54 along a suction valve axis 78 (also illustrated in FIG. 9). A multiple of windows 80, preferably four, allow fluid to flow from the multiple of radial passageways 47 and into the fluid pumping chamber 70. Most preferably, a guide radius 82 located in the skirt 74 directs fluid from the radial passageways 47 toward the windows 80 to minimize turbulent fluid flow. The guide radius 82 is preferably located about the skirt 74 and transverse to the radial passageways 47. That is, the guide radius 82 is essentially a groove within the skirt 74 which traverses the perimeter of the skirt. A skirt guide radius 83 is preferably located about an outer diameter of the skirt 74 to provide a second alignment guide for the suction valve within the valve seat 45 (FIGS. 7 and 2).

The valve seat assembly 46 and particularly the suction valve 54 are preferably coated with a low friction coating such as Tungsten Carbide Carbon or Titanium Dioxide. The coating is preferably applied through chemical vapor deposition thermal spray or the like. It should be understood that other components, coatings and application processes will benefit from the present invention.

Moreover, radiuses are extensively provided on the valve seat assembly 46, and other areas pressure bearing components, interfaces, ports, passages, bores and to reduce the likelihood of stress concentrations at a sharp corner.

The forcing cone 84 and collar 86 end of the cylindrical cartridge seal assembly 49 are sealed by a retainer nut 88 which threads into the cylindrical cartridge seal assembly 49. The retainer nut 88 retains a packing spring 90, a packing bushing 92, a packing assembly 94, a second packing bushing 96 and a support ring 98. The packing spring 90 abuts the inner cartridge stop 50, an outer cartridge guide 52 to compress the packing assembly 94 between the bushings 92, 96 and the fixed position support ring 98 and retainer nut 88.

The packing assembly 94 seals the fluid pumping chamber 70 and cycles between inlet pressure and maximum pump 12 pressure. The packing assembly 94 includes a multiple of non-metallic and metallic packing materials as generally known. An effective end seal is provided under the cyclical pressure.

Located adjacent each manifold cartridge opening 64 opening in the manifold 28 is a discharge valve opening 100. A discharge valve assembly 104 is located within the discharge valve opening 100 to abut a conical valve seat 102 in the valve seat 45. (Also illustrated in FIG. 7). The discharge valve opening 100 communicates with the suction valve assembly 46 and the fluid pumping chamber 70.

Figure 10:
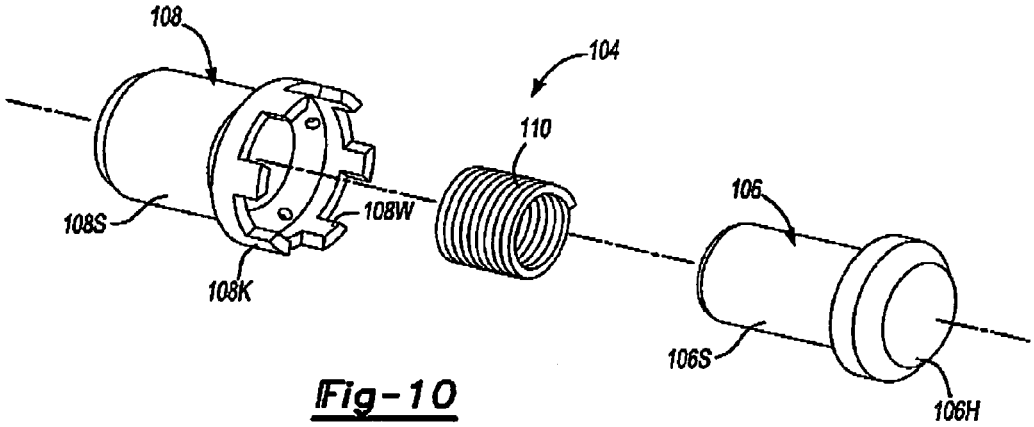
FIG. 10 is an exploded perspective view of a discharge valve assembly.

The discharge valve assembly 104 (FIG. 10) includes a discharge valve 106 biased within a discharge valve guide 108 by a valve spring 110. The discharge valve guide 108 includes a discharge valve guide skirt 108K and a discharge valve guide stem 108*s*. The discharge valve skirt 108K is of a greater diameter than the discharge valve guide stem 108*s* and defines a multitude of discharge guide windows 108W. The discharge vale 106 likewise includes a discharge valve stem 106*s* and a discharge valve head 106H which is of a greater diameter than the stem 106*s*. The discharge valve guide 108 guides the discharge valve 106. The discharge valve guide 108 does this in two different ways. First the discharge valve stem 106*s* is held in proper orientation in the smaller ID of the discharge valve guide stem 108S. Additionally, the larger diameter of the discharge valve guide skirt 108K engages with the largest OD on the discharge valve head 106H. The configuration facilitates that the discharge valve 106 is double guided which improves performance and life expectancy. Although the discharge valve guide skirt 108K is stepped-down in a frustoconical manner to the discharge valve guide stem 108*s*, the discharge valve opening 100 includes a significant radius which provides a clearance about the discharge valve guide skirt 108K. Notably, the discharge valve opening 100 defines a diameter which receives the discharge valve guide stem 108*s*, then radiuses away therefrom to provide a radiused clearance about the discharge valve guide skirt 108K which reduces turbulence and maintain the fluid flow. By providing the discharge valve opening 100 with a significant "cavity" just after the discharge valve, this design reduces the pressure drop, lower velocities and turbulent flow, improve valve movement, minimizes wea, and maintain the integrity of the seating surface.

The valve spring 110 is mounted within the valve 106 and is preferably machined on each end to assure that the valve 106 opens perpendicular to the pump centerline P. The valve spring 110 provides a biasing force that matches the cracking pressure of the valve 106. The cracking pressure is a function of the water pressure and sealing area of the valve. When the cracking pressure is reached, the discharge valve 106 overcomes the bias of the valve spring 110 and unseats from the conical valve seat 102 such that fluid flows from the valve seat assembly 46, through the valve guide 108 and into the discharge valve opening 100.

The discharge valve assembly 104 is preferably coated with a low friction coating such as Tungsten Carbide Carbon or Titanium Dioxide. The coating is preferably applied through chemical vapor deposition thermal spray or the like. It should be understood that other components, coatings and application processes will benefit from the present invention.

In operation, the plunger 26 is stroked every, 120 degrees turn of a crank (not shown) within the power frame 12 (i.e., when number 1 is on the discharge stroke, number 3 is on the suction stroke and number 2 is in-between). Once a plunger shaft 27 reaches its full outward position, its fluid pumping chamber 70 is filled with fluid and the suction valve 54 checks closed under the bias of spring 56. The plunger shaft 27 is now driven into the fluid pumping chamber 70. The plunger shaft 27 begins to displace volume within the fluid pumping chamber 70 and the fluid is forced into a smaller and smaller area. The pressure within the pump 12 thereby begins to increase and the pressure is carried by the components out to the frame 30. The plunger shaft 27 continues into the fluid pumping chambers 70 until each plunger shaft 27 reaches a full disclosure position (illustrated in FIG. 2) within fluid pumping chamber 70.

When the pressure within the fluid pumping chambers 70 reaches a predetermined pressure, the discharge valve 106 overcomes the discharge valve spring 110 and water pressure within discharge opening 100. The fluid exits through the rifle-drilled discharge passage 42 and the discharge port 38. From the discharge port 38 high pressure fluid travels out to the gun 18 (FIG. 1).

The plunger shaft 27 will then reciprocate out of the fluid pumping chambers 70 and the cycle repeats. Accordingly, an extremely high pressure fluid assembly is provided in a compact package.

Figure 11:
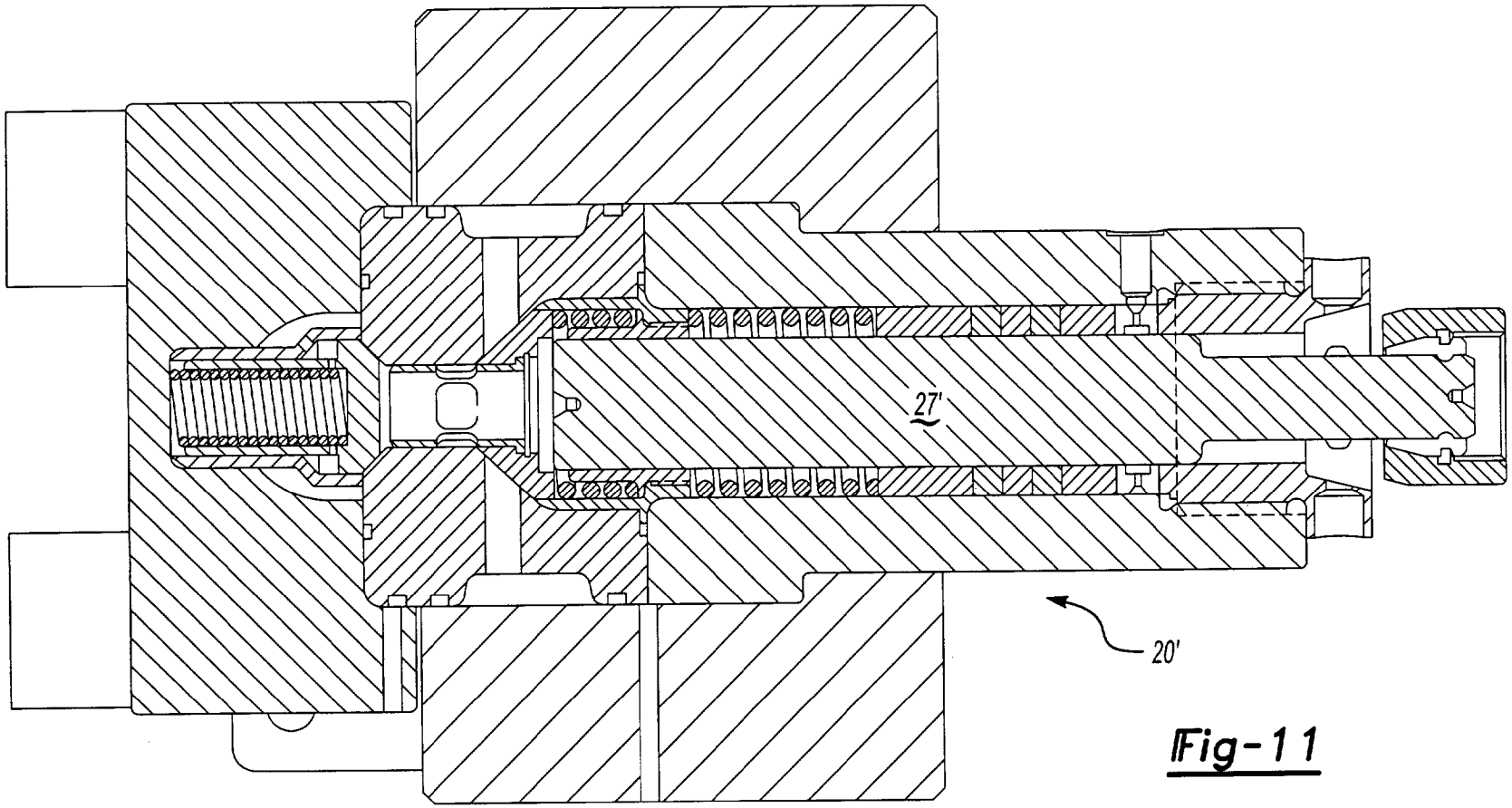
FIG. 11 is a sectional view of another fluid cylinder pump having an alternative cartridge mounted therein.

Referring to FIG. 11, an alternative cartridge 20' is mounted within the pump 12 to vary the pump output to approximately half of the flow and double the pressure of the pump 12 of FIG. 2. The pump output is primarily determined by the diameter of the plunger shaft 27', the length of the stroke, the number of cylinders and the speed of the pump. Each cartridge 20' allows replacement of all the components which interface with a plunger shaft 27' of a different diameter such that pump output or repair is readily achieved.

Generally, the total displacement of the pump is found through the following formula:

$$\text{Total displacement}=\pi/4(D)^2(\text{stroke length})(\#\text{ of cylinders})(4.329E\text{-}3)(\text{pump speed})$$

The plunger diameter D is the only non-linear variable. As such, changing the diameter of the plunger affects flow exponentially. In other words, doubling the plunger diameter will not result in doubling the flow of the pump. The pressure itself is set by putting the appropriate restriction (nozzle) into the piping so that when the given flow is sent through the nozzle, it results in the desired pressure. For example a nozzle is sized for a plunger which provides 37.8 gpm, the nozzle produces 10,000 psi.

The frame rating provides the initial starting point for design. That is, the pressure pushing on the area of the plunger must be less then or close to the frame rating. For example:

Frame load=pressure(area of plunger)

Solving for the area of the plunger we get:

Area of plunger=(frame load)/pressure

But area=$\pi/4(D)^2$ therefor $D=[(4/\pi)(\text{frame load})/\text{pressure}]^{1/2}$ In other words, as the desired pressure increases, the diameter of the plunger must decrease to stay within the frame load limit.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A high pressure fluid jetting system comprising:

a frame assembly defining a suction port;

a manifold mounted to said frame assembly, said manifold defining a discharge port;

a cartridge removably mounted within said frame assembly and said manifold, said cartridge comprising a valve seat assembly at least partially mountable within said frame assembly, said valve seat assembly including an outer cartridge guide having a flange which extends therefrom, said flange engaged with a counterbore located within a valve seat of said valve seat assembly; and an inner cartridge stop received within said outer cartridge guide, said inner cartridge stop located to receive a plunger shaft for reciprocal movement therein.

2. The system as recited in claim 1, wherein said manifold is pivotable relative said frame assembly.

3. The system as recited in claim 1, further comprising a cylindrical cartridge seal assembly with a stepped surface engageable with said frame assembly said stepped surface engageable with a counterbore within said frame assembly.

4. The system as recited in claim 1, wherein said valve seat assembly comprises a suction valve and a suction valve springs said suction valve movable relative said inner cartridge stop and said outer cartridge guide mounted within said valve seat, said suction valve biased upon a valve spring such that said suction valve is movable in response to movement of said plunger shaft.

5. The system as recited in claim 1, further comprising a bell shaped suction valve.

6. The system as recited in claim 1, further comprising a suction valve having a cylindrical body and a skirt said skirt, defining a diameter larger than a diameter defined by said cylindrical body.

7. The system as recited in claim 6, wherein said cylindrical body defines a plurality of windows.

8. The system as recited in claim 6, wherein said skirt defines a guide radius, said guide radius located in the skirt to direct fluid from a multiple of radial passageways within said valve seat assembly which supports said suction valve toward said plurality of windows located through said cylindrical body.

9. The system as recited in claim 8, wherein said multiple of radial passageways communicate with said suction port.

10. The system as recited in claim 1, further comprising a coated suction valve.

11. The system as recited in claim 10, wherein said coated suction valve comprises a Tungsten Carbide Carbon coating.

12. The system as recited in claim 10, wherein said coated suction valve comprises a Titanium Dioxide coating.

13. The system as recited in claim 1, further comprising a discharge valve assembly mounted at least partially within said manifold.

14. The system as recited in claim 1, wherein said cartridge comprises a cylindrical cartridge seal assembly and a discharge valve assembly mounted adjacent said valve seat assembly such that an interface between said valve seat assembly and said cylindrical cartridge seal assembly is located within said frame assembly.

15. The system as recited in claim 14, wherein said discharge valve assembly includes a discharge valve biased within a discharge valve guide by a valve spring, said valve spring received within said discharge valve assembly along a pump centerline.

16. A high pressure fluid jetting system comprising:

a frame assembly defining a suction port;

a manifold mounted to said frame assembly, said manifold defining a discharge port in fluid communication with a discharge valve opening;

a cartridge comprising a valve seat assembly and a cylindrical cartridge seal assembly removably mounted within said frame assembly, said valve seat assembly and said cylindrical cartridge seal assembly located to receive a plunger shaft for reciprocal movement therein; and a discharge valve assembly mounted adjacent said valve seat assembly, said discharge valve assembly including a discharge valve guide and a discharge valve received therein, said discharge valve guide includes a discharge valve guide skirt and a discharge valve guide stem, said discharge valve opening providing a radiused clearance about said discharge valve guide skirt.

17. The system as recited in claim 16, wherein said valve seat assembly comprises a valve seat, a suction valve and a suction valve spring, said suction valve movable relative an inner cartridge stop and an outer cartridge guide mounted within said valve seat, said suction valve biased upon a valve spring such that said suction valve is movable in response to movement of said plunger shaft.

18. The system as recited in claim 17, wherein said suction valve comprises a bell shaped member.

19. The system as recited in claim 16, wherein said suction valve comprises a cylindrical body and a skirt, said skirt defining a diameter larger than a diameter defined by said cylindrical body.

20. The system as recited in claim 19, wherein said cylindrical body defines a plurality of windows.

21. The system as recited in claim 20, wherein said skirt defines a guide radius transverse to a plurality of radial passages through a valve seat to direct fluid from a multiple of radial passageways within said valve seat assembly which supports said suction valve toward said plurality of windows, said plurality of radial passageways in communication with said suction port.

22. The system as recited in claim 16, wherein said discharge valve includes a discharge valve stem, a discharge valve head, and a discharge valve spring located within said discharge valve stem, said discharge valve stem is axially guided within discharge valve guide stem and said discharge valve head is axially guided within said discharge valve guide skirt along a common axis.

23. The system as recited in claim 22, wherein said discharge valve guide skirt and said discharge valve guide stem are cylindrical segments having a frustoconical step-down interface segment.

24. The system as recited in claim 23, wherein said discharge valve guide skirt is of a greater diameter than said discharge valve guide stem.

25. The system as recited in claim 16, wherein said discharge valve opening defines a bowl-shape, a base of said discharge valve opening adjacent said discharge valve guide skirt.

26. A cartridge assembly for a high pressure fluid jetting system comprising:

a valve seat assembly at least partially mountable within a frame assembly of a high pressure fluid jetting assembly, said valve seat assembly including an outer cartridge guide having a flange which extends therefrom, said flange engaged with a counterbore located within a valve seat of said valve seat assembly;

a cylindrical cartridge seal assembly removably mountable adjacent to said valve seat assembly such that an interface between said valve seat assembly and said cylindrical cartridge seal assembly is located within said frame assembly said cylindrical cartridge seal assembly comprises a first diameter, a second diameter and a stepped surface therebetween, said stepped surface engageable with a counterbore within said frame; and an inner cartridge stop received within said outer cartridge guide, said inner cartridge stop located to receive a plunger shaft for reciprocal movement therein.

27. The assembly as recited in claim 26, further comprising a packing assembly mounted within said cylindrical cartridge seal assembly and around said plunger.

28. The assembly as recited in claim 26, further comprising a threaded coupling mounted to said plunger.

29. The assembly as recited in claim 26, wherein said valve seat assembly includes a valve seat and a suction valve, said suction valve comprises a cylindrical body and a skirt, said skirt defining a diameter larger than a diameter defined by said cylindrical body.

30. The assembly as recited in claim 29, wherein said cylindrical body defines a plurality of windows transverse to a suction valve axis.

31. The assembly as recited in claim 29, wherein said suction valve is movable relative an inner cartridge stop and an outer cartridge guide mounted within said valve seat, said suction valve biased upon a valve spring such that said suction valve is movable in response to movement of said plunger shaft.

32. A suction valve for a high pressure fluid jetting system comprising:

a cylindrical body which defines a plurality of generally rectilinear_openings therethrough;

a skirt extending about said cylindrical body said skirt defining a diameter larger than a diameter defined by said cylindrical body;

a low friction coating applied to said cylindrical body and said skirt, wherein said coated suction valve comprises a Titanium Dioxide coating.

33. A discharge valve assembly for a high pressure fluid jetting system comprising:

a discharge valve guide having a discharge valve guide skirt and a discharge valve guide stem said discharge valve guide skirt is of a greater diameter than said discharge valve guide stem;

a discharge valve having a discharge valve stem and a discharge valve head of a greater diameter than said discharge valve stem, said discharge valve stem axially guided within said discharge valve guide stem and said discharge valve head axially guided within said discharge valve guide skirt along a common axis; and a discharge valve spring located within said discharge valve stem.

* * * * *

UNITED STATES PATENT AND TRADEMARK OFFICE

CERTIFICATE OF CORRECTION

PATENT NO. : 7,121,812 B2
APPLICATION NO. : 10/370158
DATED : October 17, 2006
INVENTOR(S) : Jamie A. Forrest It is certified that error appears in the above-identified patent and that said Letters Patent is hereby corrected as shown below:

Column 7, line 65: “springs” should be --spring,--

Column 10 line 29: insert --and-- after “body;”

Signed and Sealed this

Ninth Day of January, 2007

JON W. DUDAS
*Director of the United States Patent and Trademark Office*